US011067301B2

(12) United States Patent
Inoue

(10) Patent No.: US 11,067,301 B2
(45) Date of Patent: Jul. 20, 2021

(54) BLOWER AND OUTDOOR UNIT OF AIR CONDITIONER HAVING THE SAME

(71) Applicant: Samsung Electronics Co., Ltd., Suwon-si (KR)

(72) Inventor: Nozomu Inoue, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/188,205

(22) Filed: Nov. 12, 2018

(65) Prior Publication Data

US 2019/0145636 A1 May 16, 2019

(30) Foreign Application Priority Data

Nov. 13, 2017 (JP) ..... JP2017-218142
Oct. 2, 2018 (KR) ..... 10-2018-0117276

(51) Int. Cl.
*F24F 1/48* (2011.01)
*F24F 1/56* (2011.01)
(Continued)

(52) U.S. Cl.
CPC ..... *F24F 1/48* (2013.01); *F24F 1/38* (2013.01); *F24F 1/40* (2013.01); *F24F 1/50* (2013.01); *F24F 1/56* (2013.01)

(58) Field of Classification Search
CPC ..... F24F 1/38; F24F 13/24; F24F 2013/242–247; F24F 1/48;
(Continued)

(56) References Cited

U.S. PATENT DOCUMENTS 4,321,803 A * 3/1982 Smith ..... F24F 1/06 165/125
4,501,194 A * 2/1985 Brown ..... F24F 7/025 454/354
(Continued)

FOREIGN PATENT DOCUMENTS

CN 1399102 A 2/2003
CN 102829514 A * 12/2012
(Continued)

OTHER PUBLICATIONS

CN102829514A English Machine Translation (Year: 2012).*
(Continued)

*Primary Examiner* — Len Tran
*Assistant Examiner* — Jenna M Hopkins

(57) ABSTRACT

Disclosed herein is a blower blowing air and an outdoor unit of air conditioner having the same. The blower includes a fan, a motor driving the fan, and a motor support member disposed on a flow path, through which air generated by a rotation of the fan flows, to support the motor. The motor support member includes a cross-sectional shape including a maximum width portion having a maximum width in a direction perpendicular to the airflow direction, an upstream portion having a width being increased from the upstream side to the downstream side, and a downstream portion having a width being reduced from the upstream side to the downstream side. A downstream end located downstream of the downstream portion has a width in a direction perpendicular to the airflow direction.

20 Claims, 23 Drawing Sheets

(51) Int. Cl.
*F24F 1/38* (2011.01)
*F24F 1/40* (2011.01)
*F24F 1/50* (2011.01)

(58) Field of Classification Search
CPC ..... F24F 2013/205; F24F 1/12; F24F 1/40; F04D 29/646
USPC ..... 62/248, 416, 507, 296, 285, 295
See application file for complete search history.

(56) References Cited

U.S. PATENT DOCUMENTS

| | | | | | |
|---|---|---|---|---|---|
| 6,074,182 | A * | 6/2000 | Matson | F04D 25/08 | 417/423.14 |
| 6,190,140 | B1 * | 2/2001 | Matson | F04D 25/08 | 417/362 |
| 6,503,060 | B1 * | 1/2003 | Kamada | F04D 29/544 | 416/247 R |
| 7,963,121 | B2 * | 6/2011 | Ishida | F24F 1/38 | 62/428 |
| 7,971,448 | B2 * | 7/2011 | Kim | F04D 29/541 | 62/285 |
| 9,169,851 | B2 * | 10/2015 | Oh | F04D 25/08 | |
| 9,759,436 | B2 * | 9/2017 | Jinnai | F24F 13/32 | |
| 9,822,801 | B2 * | 11/2017 | Nakagawa | F24F 1/50 | |
| 10,514,046 | B2 * | 12/2019 | Stauter | F04D 29/5826 | |
| 10,578,322 | B2 * | 3/2020 | Sato | F04D 19/002 | |
| 2009/0114376 | A1 * | 5/2009 | Ishida | F24F 1/38 | 165/104.31 |
| 2010/0175407 | A1 * | 7/2010 | Kim | F04D 29/541 | 62/285 |
| 2013/0239605 | A1 * | 9/2013 | Oh | F04D 25/08 | 62/428 |
| 2014/0245776 | A1 * | 9/2014 | Choi | F24F 1/38 | 62/426 |
| 2014/0301825 | A1 * | 10/2014 | Tian | F04D 29/30 | 415/53.1 |
| 2015/0159892 | A1 * | 6/2015 | Jung | F04D 29/646 | 454/338 |
| 2016/0097548 | A1 * | 4/2016 | Wang | F04D 25/0613 | 62/507 |
| 2017/0102007 | A1 * | 4/2017 | Stauter | F24F 1/38 | |
| 2018/0266723 | A1 * | 9/2018 | Mori | F24F 13/24 | |

FOREIGN PATENT DOCUMENTS

| | | | | | |
|---|---|---|---|---|---|
| CN | 104697075 | A * | 6/2015 | F04D 19/002 | |
| EP | 1953465 | A1 | 8/2008 | | |
| EP | 2535660 | A2 | 12/2012 | | |
| JP | S5544124 | U * | 3/1980 | | |
| JP | S6141565 | U * | 10/1981 | | |
| JP | H05-093531 | A | 4/1993 | | |
| JP | H05-203197 | A | 8/1993 | | |
| JP | H07-225036 | A | 8/1995 | | |
| JP | 11023009 | A * | 1/1999 | F24F 1/38 | |
| JP | 2005315468 | A * | 11/2005 | | |
| JP | 2007147249 | A | 6/2007 | | |
| JP | 2009-58149 | A | 3/2009 | | |
| JP | 2009133621 | A * | 6/2009 | | |
| JP | 2010060242 | A * | 3/2010 | | |
| JP | 2010060242 | A | 3/2010 | | |
| JP | 2013-2642 | A | 1/2013 | | |
| KR | 10-2005-0119492 | A | 12/2005 | | |
| KR | 10-2008-0068066 | A | 7/2008 | | |
| KR | 10-0916637 | B1 | 9/2009 | | |
| WO | WO-0151858 | A1 * | 7/2001 | F04D 29/601 | |
| WO | WO-2009113338 | A1 * | 9/2009 | F04D 29/526 | |
| WO | WO-2015084030 | A1 * | 6/2015 | F04D 29/663 | |
| WO | WO-2016203636 | A1 * | 12/2016 | F24F 1/48 | |

OTHER PUBLICATIONS

JP5322542 English Machine Translation—Corresponds to JP2010060242A (Year: 2010).*
JP2005315468A English Machine Translation (Year: 2005).*
JP2009133621A English Machine Translation (Year: 2009).*
JPS5544124U English Machine Translation (Year: 1980).*
JPS6141565U English Machine Translation (Year: 1981).*
International Search Report regarding International Application No. PCT/KR2018/013663, dated Mar. 14, 2019, 4 pages.
Supplementary European Search Report in connection with European Application No. 18877228.9 dated Oct. 19, 2020, 11 pages.

* cited by examiner

BLOWER AND OUTDOOR UNIT OF AIR CONDITIONER HAVING THE SAME

CROSS-REFERENCE TO RELATED APPLICATIONS

This application is based on and claims priority under 35 U.S.C. § 119 to Korean Patent Application No. 10-2018-0117276, filed on Oct. 2, 2018, in the Korean Intellectual Property Office, and Japan Patent Application No. 2017-218142, filed on Nov. 13, 2017, in the Japan Intellectual Property Office the disclosures of which are incorporated by reference herein in its entirety

BACKGROUND

1. Field

Embodiments of the present disclosure relate to a blower blowing air and an outdoor unit of air conditioner having the same.

2. Description of Related Art

An outdoor unit of air conditioner includes a fan blowing air by being rotated, a heat exchanger exchanging heat with air blown by the fan, a motor driving the fan, and a motor support member supporting the motor.

As for the various types outdoor unit of air conditioner, the outdoor unit of air conditioner having a motor support member and a rectifying member is known. The motor support member is formed of a rigid material so that the motor support member can support the motor. The rectifying member is installed upstream of the airflow direction of the motor support member and guides air flowing toward the motor support member.

Since the motor support member is disposed on the flow path for guiding air flowing by the fan, the flow resistance and noise can be increased or decreased depending on the shape of the motor support member.

SUMMARY

Therefore, it is an aspect of the present disclosure to provide a blower capable of reducing a flow resistance and noise generated by a motor support member supporting a motor, and an outdoor unit of air conditioner having the same.

Additional aspects of the present disclosure will be set forth in part in the description which follows and, in part, will be obvious from the description, or may be learned by practice of the present disclosure.

In accordance with an aspect of the disclosure, an outdoor unit of air conditioner includes a blower configured to flow air, a heat exchanger disposed upstream of the airflow direction of the blower, and a housing configured to accommodate the blower and the heat exchanger. The blower includes a fan, a motor driving the fan, and a motor support member disposed on a flow path, through which air generated by a rotation of the fan flows, to support the motor. The motor support member includes a cross-sectional shape including a maximum width portion having a maximum width in a direction perpendicular to the airflow direction, an upstream portion having a width being increased from the upstream side to the downstream side, and a downstream portion having a width being reduced from the upstream side to the downstream side. A downstream end located downstream of the downstream portion has a width in a direction perpendicular to the airflow direction.

The upstream portion may have a cross-sectional shape having a width curvedly increased, the downstream portion may have a cross-sectional shape having a width curvedly reduced, and the upstream portion and the downstream portion may have a cross-section curvedly connected therebetween.

A ratio of an upstream portion length to the maximum width may be equal to or greater than 1.00 and equal to or less than 1.50.

A ratio of a downstream portion length to the upstream portion length may be equal to or greater than 0.58 and equal to or less than 1.00.

A ratio of a downstream end width to the maximum width may be equal to or greater than 0.86 and equal to or less than 0.94

The cross-sectional shape of the motor support member may be formed on some portions of the motor support member in a longitudinal direction of the motor support member.

The cross-sectional shape of the motor support member may be formed on some portions adjacent to a blade of the fan.

The cross-sectional shape of the motor support member may be formed on some portions adjacent to the motor.

The motor support member may include a motor supporter formed of a metal material to form the downstream side of the motor support member and a rectifying member formed of a resin material to form the upstream side of the motor support member.

The motor supporter may include an opening opened upstream, and the rectifying member is provided in such a manner that a downstream end portion thereof is inserted into the opening.

The motor support member may further include a sealing member configured to seal between the motor supporter and the rectifying member.

The outdoor unit of air conditioner may further include an additional rectifying member installed on a cross section of the downstream side of the motor supporter.

The additional rectifying member may be formed in a shape corresponding to a shape obtained by rotating a half of the cross-sectional shape of the motor support member by 90 degrees clockwise or counterclockwise.

The outdoor unit of air conditioner may further include a step formed in such a manner a width of the additional rectifying member is smaller than the downstream end width of the motor supporter.

The motor supporter may include an opening opened upstream, and the rectifying member surrounds an upstream side, opposite side surfaces and a downstream side of the motor supporter.

The downstream side end portion of the rectifying member is formed in a shape corresponding to a shape obtained by rotating a half of the cross-sectional shape of the motor support member by 90 degrees clockwise or counterclockwise.

In accordance with an aspect of the disclosure, a blower includes a fan, a motor driving the fan, and a motor support member disposed on a flow path, through which air generated by a rotation of the fan flows, to support the motor. The motor support member includes a cross-sectional shape including a maximum width portion having a maximum width in a direction perpendicular to the airflow direction, an upstream portion having a width being increased from the upstream side to the downstream side, and a downstream portion having a width being reduced from the upstream side to the downstream side. A downstream end located downstream of the downstream portion has a width in a direction perpendicular to the airflow direction.

Before undertaking the DETAILED DESCRIPTION below, it may be advantageous to set forth definitions of certain words and phrases used throughout this patent document: the terms "include" and "comprise." as well as derivatives thereof, mean inclusion without limitation; the term "or," is inclusive, meaning and/or, the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

FIGS. 1 through 21, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter an outdoor unit of air conditioner according to embodiments will be described in detail with reference to the accompanying drawings.

Background and Overview of the Present Embodiment

There is growing need of an air conditioner that is smaller in size and higher in efficiency with the commerciality and an air conditioner has been developed with focus on the increase of the airflow rate.

As the airflow rate is increased, the blowing noise is increased in the air conditioner. Therefore, in order to increase the airflow rate while reducing the noise, it is required to improve the shape of structure installed on a flow path through which air flows, and the shape of the fan.

Embodiments relate to a structure for reducing a flow resistance and a noise generated by a motor support member, which is a structure disposed in the flow path through which air flows. For this, embodiments relate to reducing the pressure variation by making a width of a vortex, which is generated on the downstream side in the air flow direction by the motor support member, small, by improving a cross-sectional shape of the motor support member, and a structure and an arrangement of the motor support member.

Figure 1:
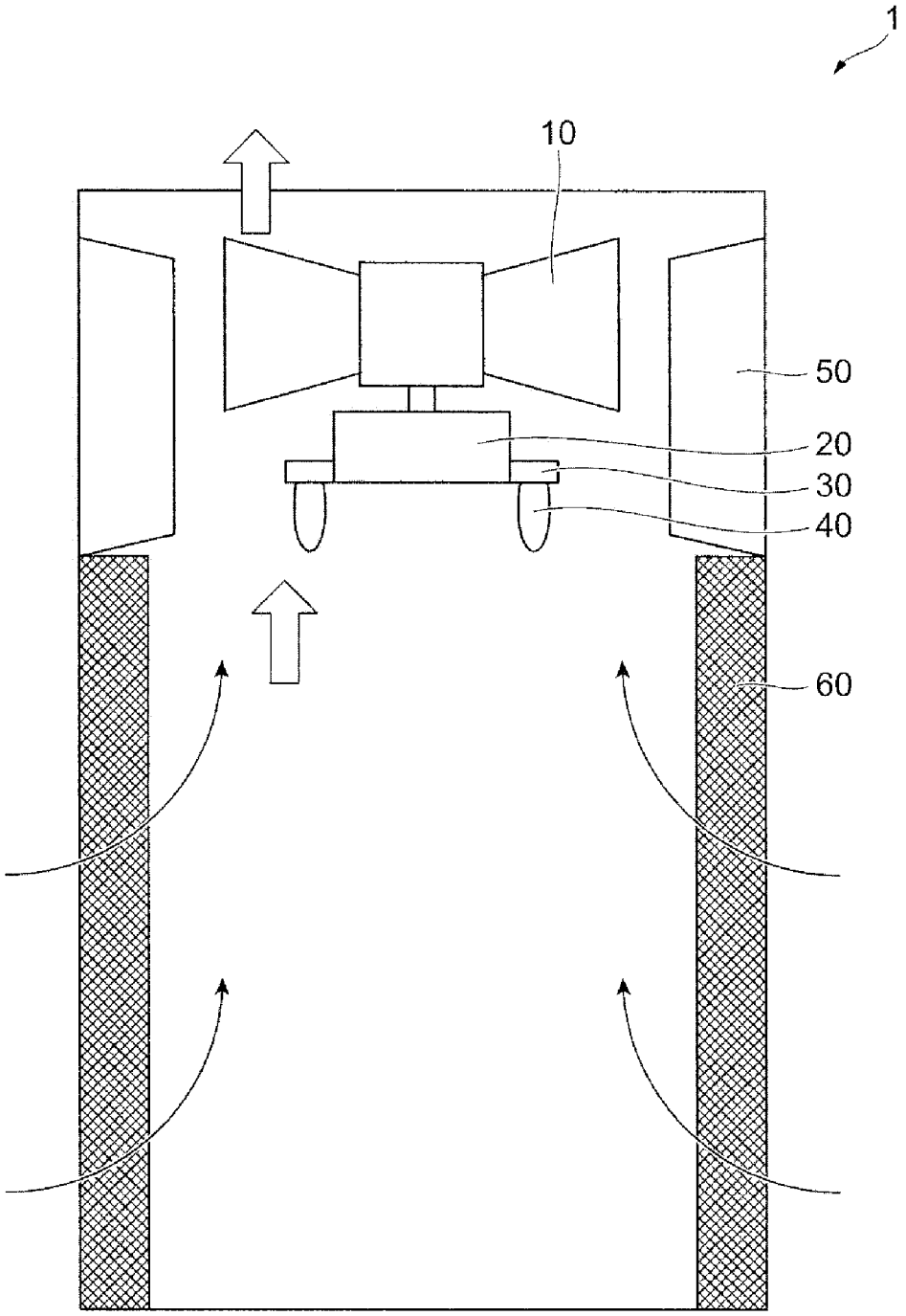
FIG. 1 is a schematic view illustrating an outdoor unit of air conditioner according to a first embodiment.

FIG. 1 is a schematic view illustrating an outdoor unit 1 of air conditioner according to a first embodiment.

The outdoor unit 1 includes a blower blowing air and a heat exchanger 60 arranged upstream of the blower to perform heat exchange with air blown by the blower.

The blower includes a fan 10 suctioning and discharging air by being rotated, a motor 20 driving the fan 10, a leg portion 30, a motor support member 40, and a bell mouth 50.

The fan 10 receives a torque and rotates to allow air to flow in a direction of a white arrow. As the air flows in the direction of the white arrow by the fan 10, the air flows in a direction of a black arrow and passes through the heat exchanger 60.

The motor 20 receives a power to generate a torque and transmits the torque to the fan 10 through a rotating shaft. The leg portion 30 is in contact with the motor 20 to directly support the motor 20. The motor support member 40 is fixed to the leg portion 30 and supports the motor 20 through the leg portion 30.

The bell mouth 50 forms a flow path for guiding the air that flows in accordance with the rotation of the fan 10, and the motor support member 40 is disposed in the flow path.

The heat exchanger 60 allows a refrigerant to exchange heat with the air passing through the heat exchanger 60 in the direction of the black arrow.

In addition, the outdoor unit 1 includes a compressor (not shown) compressing the refrigerant, an expansion valve (not shown) expanding and decompressing the refrigerant, and a refrigerant pipe (not shown) transmitting the refrigerant.

The outdoor unit 1 is an upper discharge type outdoor unit, and thus the motor support member 40 is disposed upstream of the airflow direction than the fan 10.

The motor support member 40 of the outdoor unit 1 is installed higher than an upper end of the heat exchanger 60. That is, the motor support member 40 is installed more downstream of the airflow direction than an end portion of the heat exchanger 60 in the downstream side of the airflow direction.

The motor support member 40 is extended in the front-rear direction so that the front end and the rear end thereof are fixed to the inside of the outdoor unit 1.

The motor support member 40 is extended in the front-rear direction, but is not limited thereto. The motor support member 40 may be extended in the left-right direction or the diagonal direction. Hereinafter a direction in which the motor support member 40 is extended is referred to as a longitudinal direction of the motor support member 40 and the longitudinal direction of the motor support member 40 is referred as a direction perpendicular to the cross section of the motor support member 40.

Figure 2:
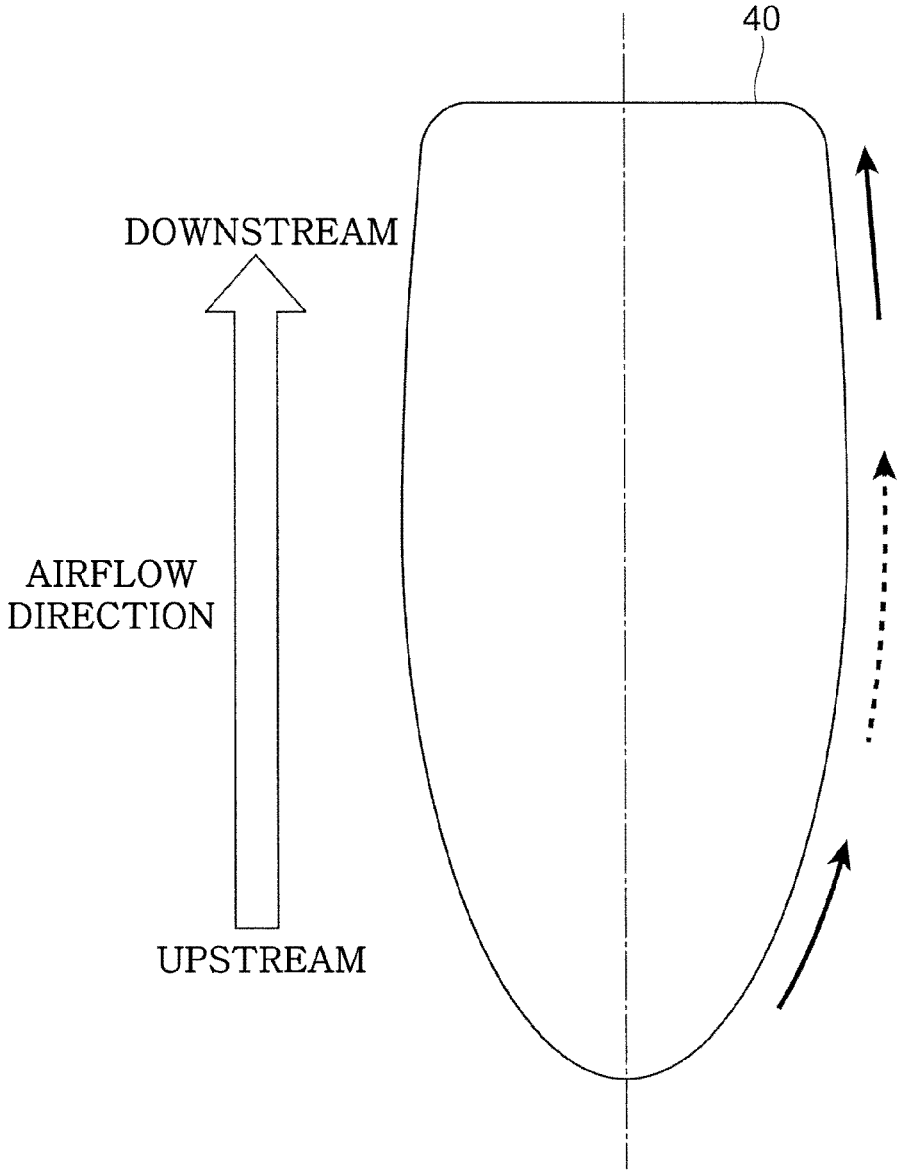
FIG. 2 is a cross-sectional view illustrating a motor support member according to a first embodiment.

FIG. 2 is a cross-sectional view of the motor support member 40, and the motor support member 40 is formed in a substantially streamlined wing. The motor support member 40 includes a cross-sectional shape including a maximum width portion that is a portion having a maximum width in a direction perpendicular to the airflow direction at a cross section perpendicular to the longitudinal direction, an upstream portion that is located upstream of the airflow direction with respect to the maximum width portion, and a downstream portion located downstream of the airflow direction with respect to the maximum width portion.

The upstream portion of the motor support member 40 has a cross-sectional shape having a width thereof increased from the upstream side to the downstream side in the airflow direction, as illustrated by a solid line arrow. Particularly, the upstream portion of the motor support member 40 has a cross-sectional shape having a width thereof that is curvedly increased from the upstream side to the downstream side.

The downstream portion of the motor support member 40 has a cross-sectional shape having a width thereof reduced from the upstream side to the downstream side, as illustrated by a solid line arrow. Particularly, the downstream portion of the motor support member 40 has a cross-sectional shape having a width thereof that is curvedly reduced from the upstream side to the downstream side.

In the cross-sectional shape of the motor support member 40, a portion, which forms the maximum width portion between the upstream portion and the downstream portion, has a cross-sectional shape smoothly connected as a curved line, as illustrated by a broken line arrow.

In addition, a downstream end located downstream of the downstream portion in the airflow direction of the motor support member 40 has a width formed in such a manner that the middle of a wing-shaped reduction portion is cut out in a plane substantially perpendicular to the rotating shaft of the fan 10. That is, the downstream end of the motor support member 40 has a width in a direction perpendicular to the airflow direction. According to embodiments, the downstream end of the motor support member 40 is formed in a linear shape substantially perpendicular to the airflow direction.

Figure 3:
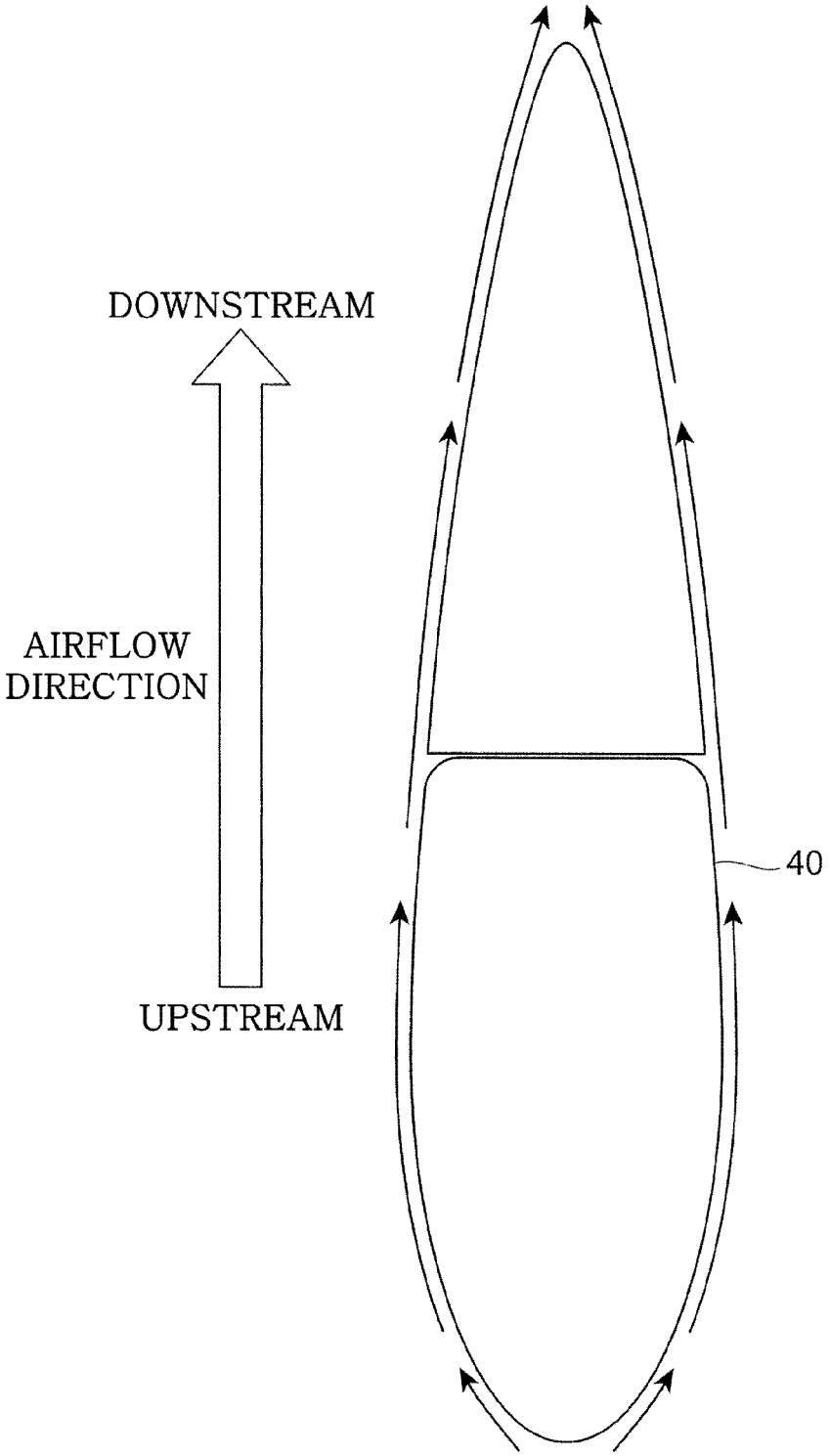
FIG. 3 is a view illustrating airflow generated by the motor support member.

FIG. 3 is a view illustrating the flow of air passing through the motor support member 40. As air flows along the motor support member 40 having the cross sectional shape shown in FIG. 2, air flows in a virtual wing cross-sectional shape, as illustrated by an arrow.

Figure 4:
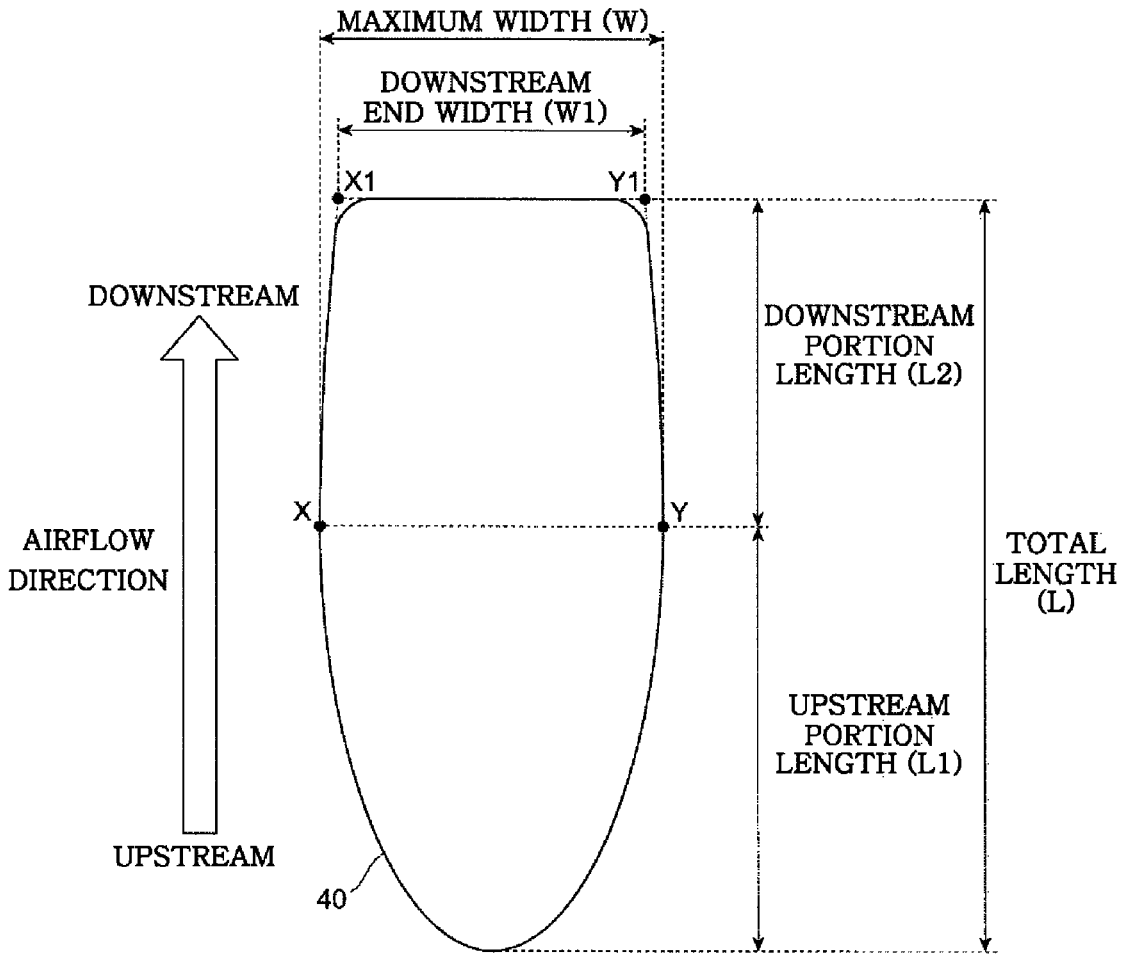
FIG. 4 is a view illustrating a dimension name of the cross-sectional view of the motor support member.

FIG. 4 is a view illustrating a dimension name of the cross-sectional view of the motor support member 40. As illustrated, the maximum width of the cross section of the motor support member 40 is referred to as "W". That is, when a point of the left side and a point of the right side in the maximum width in which a width of the cross section of the motor support member 40 becomes the maximum is referred to as "X" and "Y", a distance between the point X and the point Y becomes the maximum width W.

With respect to the cross-section of the motor support member 40, a width of an end portion of the motor support member 40 (hereinafter referred to as "a downstream end width) downstream of the airflow direction is referred to as "W1". Particularly, left and right points of the intersection between an extension line to the downstream side of the motor support member 40 and an extension line of the downstream end of the motor support member 40 are respectively referred to as "X1" and "Y1" and a distance between the point X1 and the point Y1 is referred to as the downstream end width (W1).

With respect to the cross-section of the motor support member 40, a length from an upstream end to the downstream end is referred to as a total length (L). A length of the portion, which is from the upstream end of the motor support member 40 to the portion having the maximum width of the motor support member 40 (hereinafter referred to as the "upstream portion"), is referred to as an upstream portion length (L1), and a length of a portion, which is from the portion having the maximum width of the support member 40 to the downstream end of the motor support member 40 (hereinafter referred to as the "downstream portion"), is referred to as a downstream portion length (L2).

Figure 5:
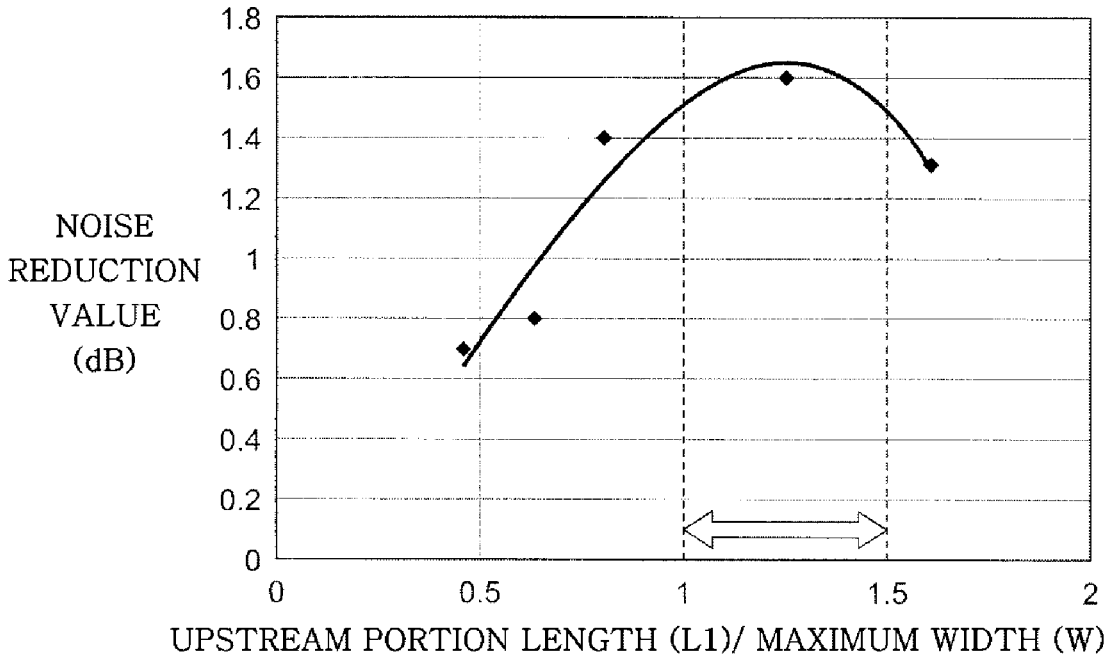
FIG. 5 is a graph for examining a ratio value between an upstream portion length and a maximum width in the motor support member.

FIG. 5 is a graph for examining a ratio value (L1/W) between the upstream portion length (L1) and the maximum width (W). Based on the graph, it is identified that a noise reduction value is sufficiently great when the ratio (L1/W) between the upstream portion length (L1) and the maximum width (W) is equal to or greater than 1.00 and equal to or less than 1.50. As illustrated by a double white arrow, it is appropriate that the ratio (L1/W) between the upstream portion length (L1) and the maximum width (W) is equal to or greater than 1.00 and equal to or less than 1.50.

Figure 6:
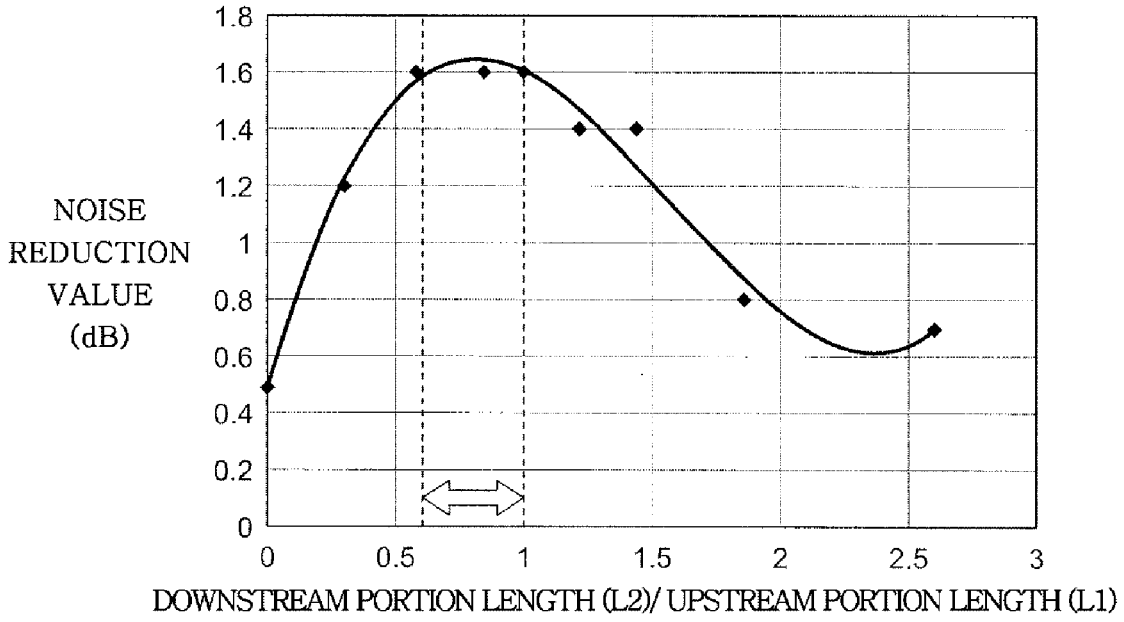
FIG. 6 is a graph for examining a ratio value between a downstream portion length and the upstream portion length in the motor support member.

FIG. 6 is a graph for examining a ratio value (L2/L1) between the downstream portion length (L2) and the upstream portion length (L1). Based on the graph, it is identified that a noise reduction value is sufficiently great when the ratio (L2/L1) between the downstream portion length (L2) and the upstream portion length (L1) is equal to or greater than 0.58 and equal to or less than 1.00. As illustrated by a double white arrow, it is appropriate that the ratio (L2/L1) between the downstream portion length (L2) and the upstream portion length (L1) is equal to or greater than 0.58 and equal to or less than 1.00.

Figure 7:
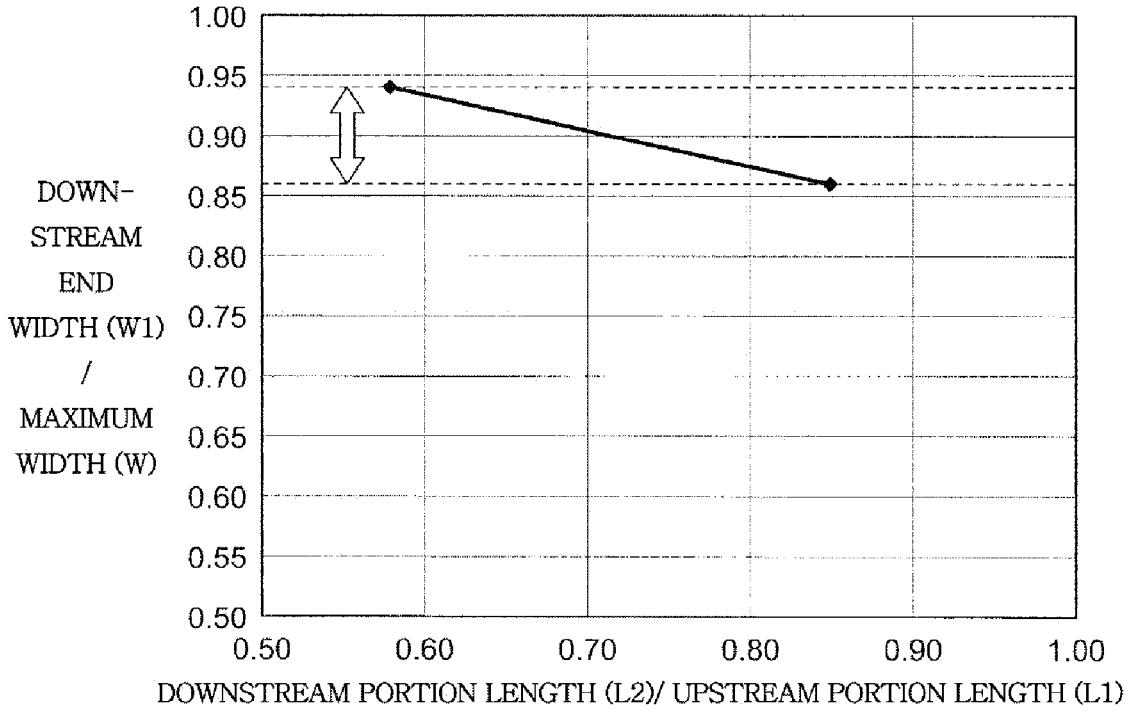
FIG. 7 is a graph for examining a ratio value between a downstream end width and the maximum width in the motor support member.

FIG. 7 is a graph for examining a ratio value (W1/W) between the downstream end width (W1) and the maximum width (W). Based on the graph, it is identified that the ratio (W1/W) between the downstream end width (W1) and the maximum width (W) is acquired by the ratio (L2/L1) between the downstream portion length (L2) and the upstream portion length (L1). When the ratio (W1/W) between the downstream end width (W1) and the maximum width (W) is greater than 0.94, it is difficult to reduce the width of the airflow formed in a virtual wing cross-sectional shape in the downstream of the motor support member 40 of FIG. 3.

Conversely, when the ratio (W1/W) between the downstream end width (W1) and the maximum width (W) is less than 0.86, it is difficult to secure the rigidity of the motor support member 40 and thus it is difficult to secure a space for installing the motor 20 and a space for forming a coupling portion. Therefore, as illustrated by a double white arrow of FIG. 6, it is identified that the ratio (W1/W) between the downstream end width (W1) and the maximum width (W) is equal to or greater than 0.86 and equal to or less than 0.94.

In addition, the above mentioned conditions of dimensions are acquired by a result of a test in which the blower is used in the outdoor unit 1, but is not limited thereto. Therefore, it is possible to use conditions of dimensions acquired by considering aerodynamics when the blower is used alone. Particularly, it is possible to use a condition in which the upstream portion length (L1) is greater than the maximum width (W) or a condition in which the upstream portion length (L2) is less than the maximum width (W).

Next, a configuration of the cross-sectional shape of the motor support member 40 will be described in details.

First Embodiment

Figure 8:
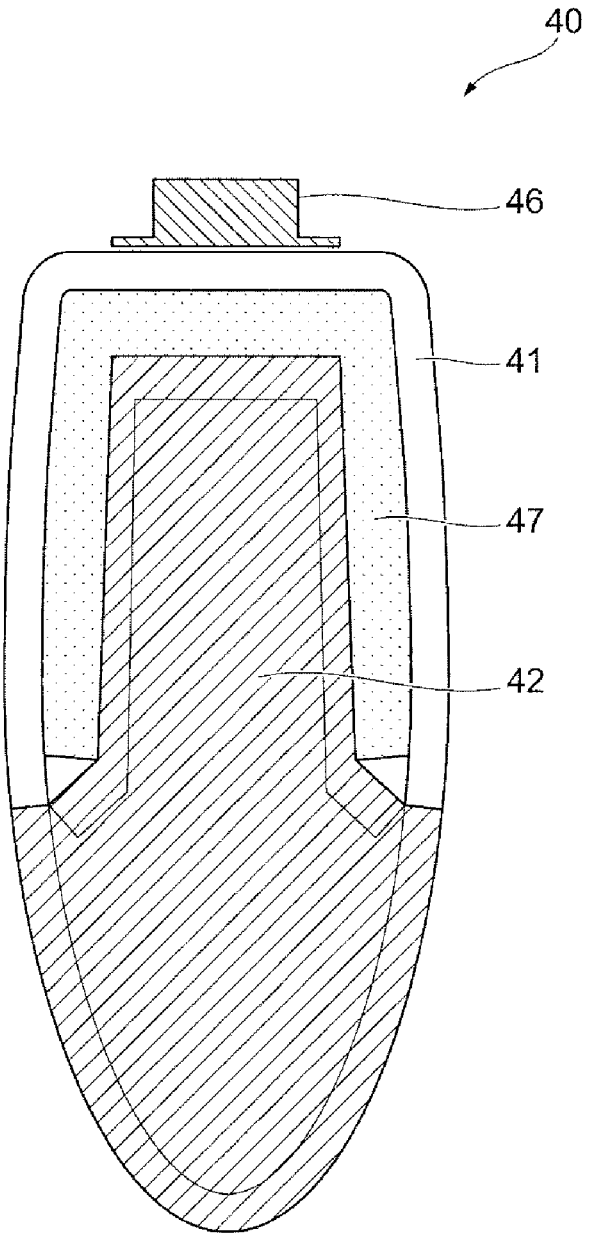
FIG. 8 is a view illustrating a configuration of the motor support member according to the first embodiment.

FIG. 8 is a view illustrating a configuration of the motor support member 40 according to the first embodiment.

As mentioned above, the motor support member 40 has a cross-sectional shape in which the upstream portion and the downstream portion are gently connected to each other so as to allow the air to flow from the upstream to the downstream of the airflow direction in the virtual wing shape.

The motor support member 40 includes a motor supporter 41 formed of a metal material to form the downstream of the motor support member 40 and a rectifying member 42 formed of a resin material to form the upstream of the motor support member 40.

The motor supporter 41 of the motor support member 40 is formed of a member having certain strength such as a metal so as to support the motor 20.

Figure 9:
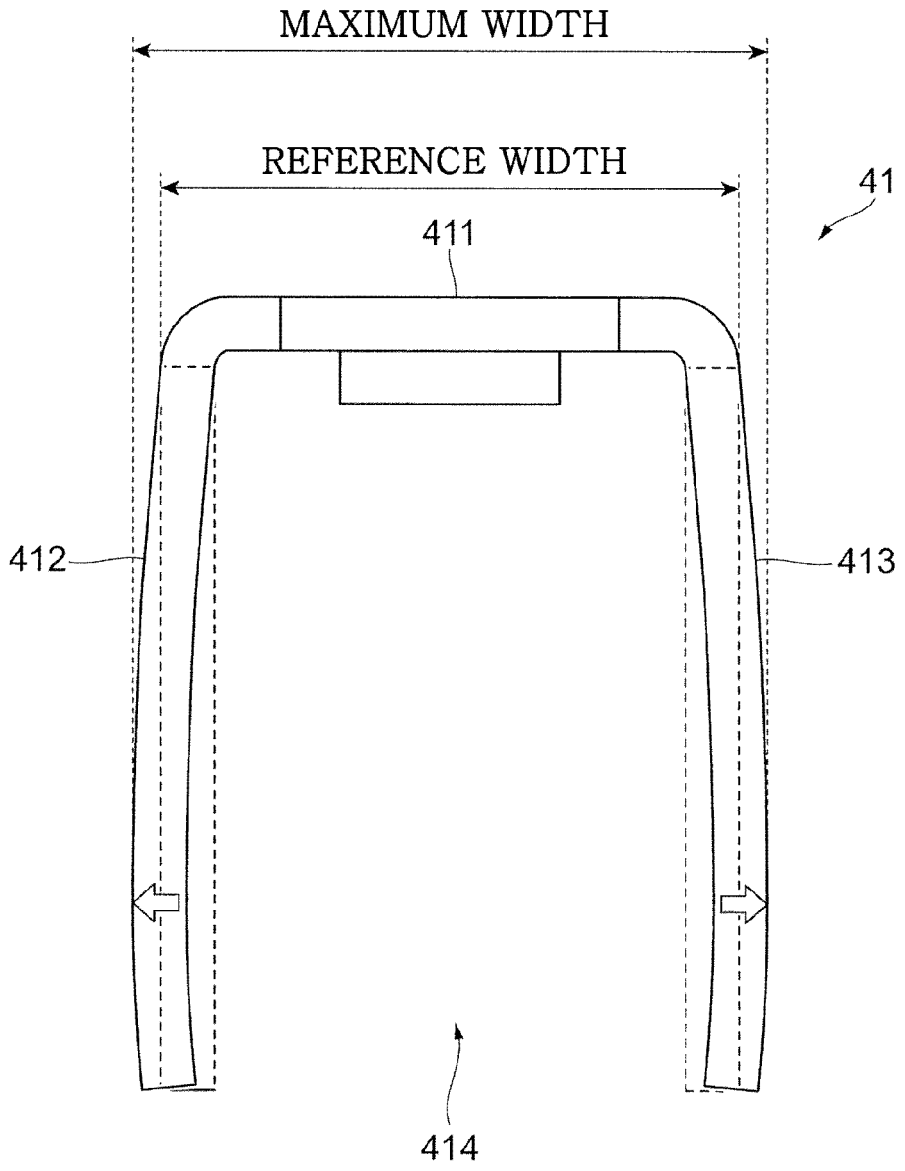
FIG. 9 is a cross-sectional view illustrating a motor supporter of the motor support member.

As illustrated in FIG. 9, the motor supporter 41 includes an opening 414 opened upstream and configured to have a cross-sectional shape surrounding the downstream of the motor support member 40 by using three thin and elongated portions 411, 412 and 413. The motor supporter 41 includes a downstream surface portion 411 forming a downstream surface thereof and opposite side surface portions 412 and 413 extending upstream from opposite sides of the downstream surface portion 411. The opposite side surface portions 412 and 413 form the maximum width portion forming the maximum width. A downstream end portion of the rectifying member 42 is inserted into the opening 414 of the motor supporter 41 and then in contact with an inner surface of the portions 412 and 413 extended from the upstream to the downstream of the motor supporter 41. The motor supporter 41 is fixed to the rectifying member 42 through a screw 46.

A sealing member 47 is provided between the motor supporter 41 and the rectifying member 42. Therefore, the sealing member 47 prevents water from flowing through a gap between the motor supporter 41 and the rectifying member 42.

Figure 10:
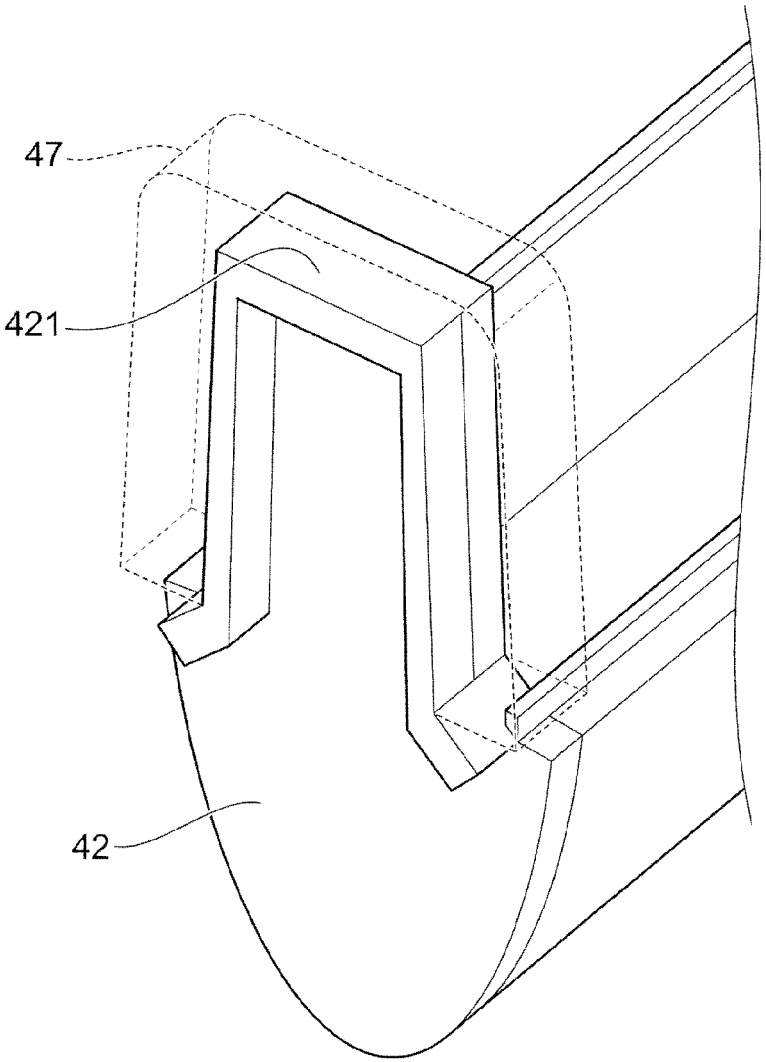
FIG. 10 is a perspective view illustrating a mounting structure of a sealing member in the motor support member.

FIG. 10 is a perspective view illustrating a state in which the sealing member 47 is installed between the motor supporter 41 and the rectifying member 42.

It is appropriate that the sealing member 47 is installed at an end portion in a direction perpendicular to FIG. 1. Further, in order to stably install the sealing member 47 or reliably seal a portion to be sealed, it is appropriate that a sheet 421 is installed on the rectifying member 42. In addition, the sealing member 47 is installed to fill the gap between the motor supporter 41 and the rectifying member 42, but is not limited thereto. A cap formed of a resin may be installed instead of the sealing member 47.

Although not shown, when the upstream side of the motor supporter 41 is covered with the rectifying member 42, it is appropriate to form a discharge port in a lower side of the rectifying member 42.

When installing the discharge port, a slop inclined toward the discharge port may be provided at the lower side of the rectifying member 42 to effectively discharge water through the discharge port.

Figure 11:
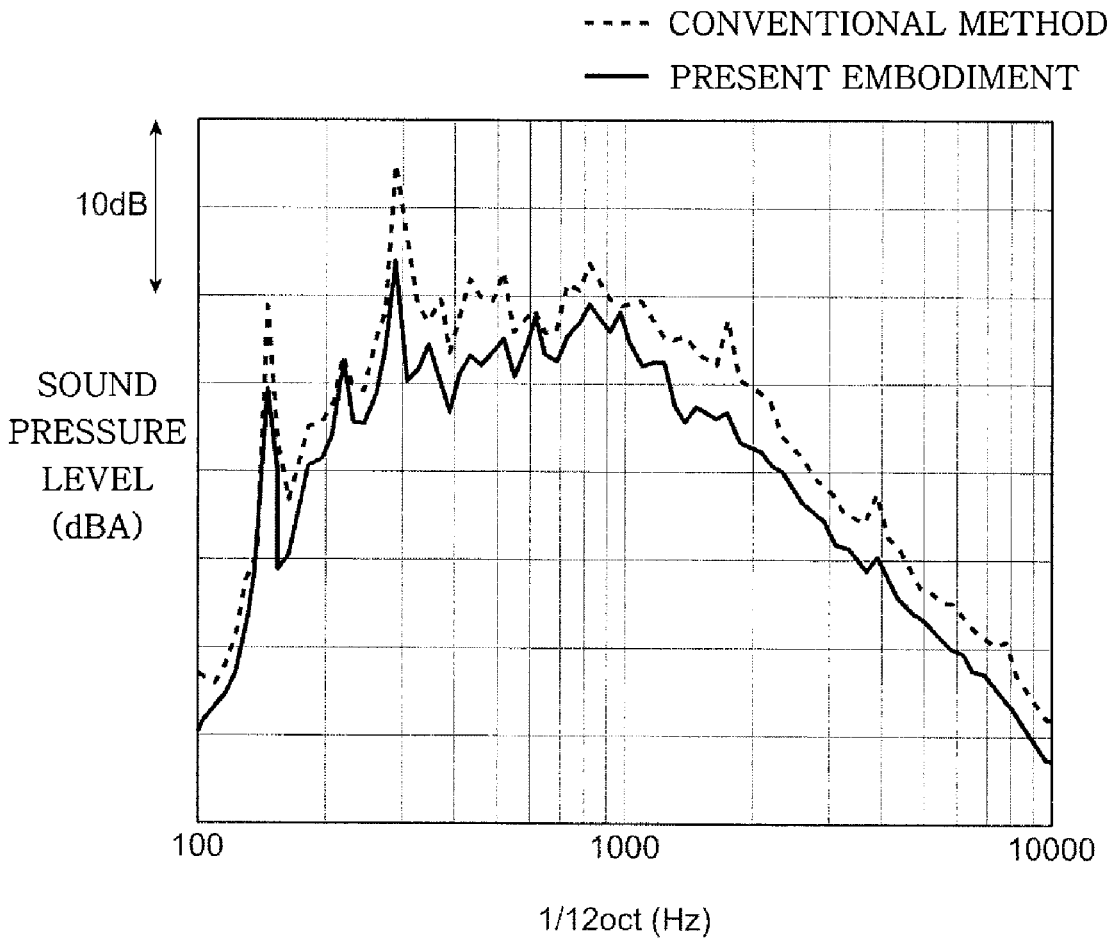
FIG. 11 is a graph illustrating a noise reduction value of blowing air acquired by a test that is actually performed with the motor support member according to the first embodiment.

FIG. 11 is a graph illustrating a test result of a noise reduction effect. A broken line in the graph indicates the noise when the motor support member 40 having the conventional cross-sectional shape is applied, and a solid line indicates the noise when the motor support member 40 having the cross-sectional shape (cross-sectional shape shown in FIG. 2) is applied. As illustrated in the graph, when the motor support member 40 having the cross-sectional shape according to the embodiment is applied, it is identified that the noise is reduced by approximately 3.0 dB in comparison with the case where the motor support member 40 having the conventional cross-sectional shape is applied.

Second Embodiment

Figure 12:
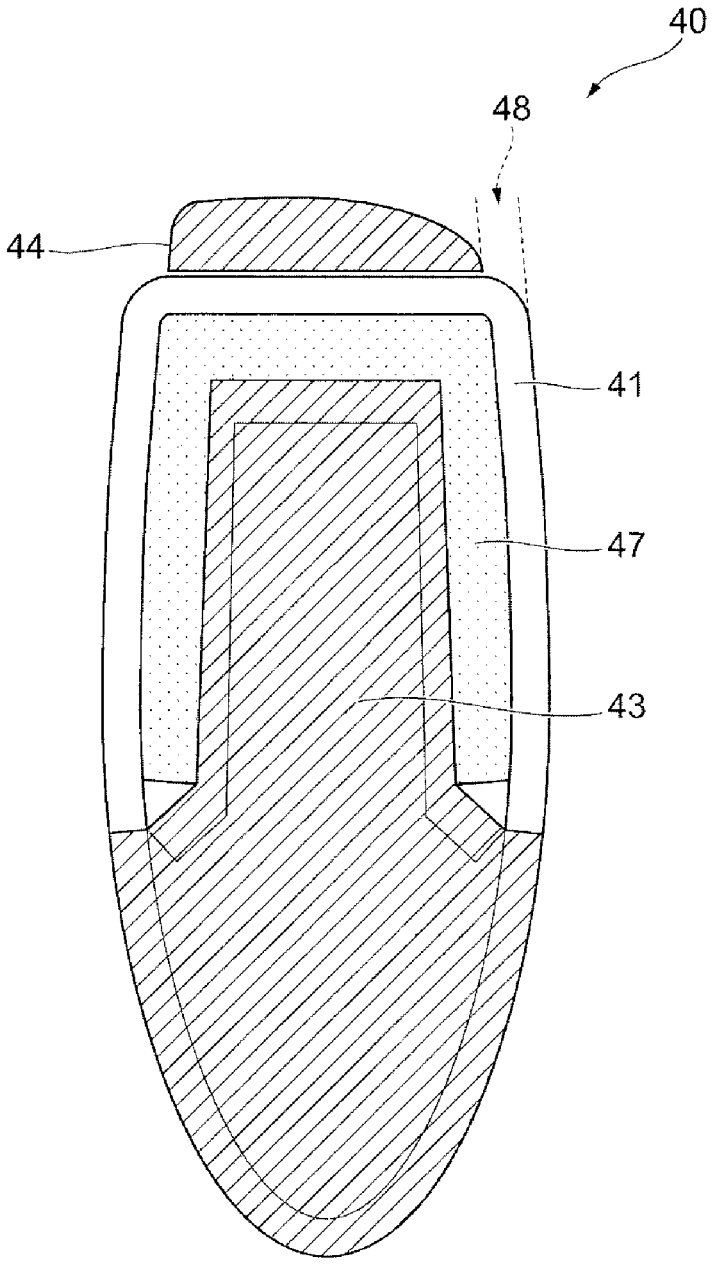
FIG. 12 is a view illustrating a configuration of a motor support member according to a second embodiment.

FIG. 12 is a view of a motor support member 40 according to a second embodiment.

As illustrated in FIG. 12, according to the second embodiment, the motor support member 40 includes a motor supporter 41 forming a downstream side of the motor support member 40 and a rectifying member 43 forming an upstream side of the motor support member 40, and further include an additional rectifying member 44 installed on a cross-section of the downstream side of the motor supporter 41.

The rectifying member 43 and the additional rectifying member 44 formed of a resin material are inserted to the upstream side and the downstream side of the motor supporter 41, respectively and are fixed to the motor support member 41 through screws.

The first rectifying member 43 is a rectifying member provided upstream of the motor supporter 41 and corresponds to the rectifying member 42 disclosed in the first embodiment.

The second rectifying member 44 is a rectifying member provided downstream of the motor supporter 41, and is installed on cross-section of the downstream side of the motor supporter 41.

According to the second embodiment, the cross-sectional shape of the additional rectifying member 44 is formed in a shape corresponding to the cross-sectional shape of the motor support member 40 as illustrated in FIG. 12. That is, the additional rectifying member 44 is formed in a shape corresponding to a shape obtained by rotating the right half of the cross-sectional shape of the motor support member 40 by 90 degrees counterclockwise.

The above mentioned shape of the additional rectifying member 44 has been described with a condition that the motor 20 is located on the right side of the motor support member 40, but is not limited thereto. Therefore, when the motor 20 is located on the left side of the motor support member 40, the additional rectifying member 44 may be formed in a shape corresponding to a shape obtained by rotating the left half of the cross-sectional shape of the motor support member 40 by 90 degrees clockwise.

According to second embodiment, the second rectifying member 44 may be changed in the longitudinal direction of the motor support member 40 while having the cross-sectional shape according to embodiments. That is, it is possible to form the maximum width portion, the upstream portion, the downstream portion, and the downstream end on some portions in the longitudinal direction of the motor support member 40.

As illustrated in the second embodiment, when the additional rectifying member 44 is added, a step 48 is formed between the additional rectifying member 44 and the motor supporter 41. The step 48 is formed in such a manner a width of the additional rectifying member 44 is smaller than the downstream end width (W1) of the motor supporter 41.

Third Embodiment

Figure 13:
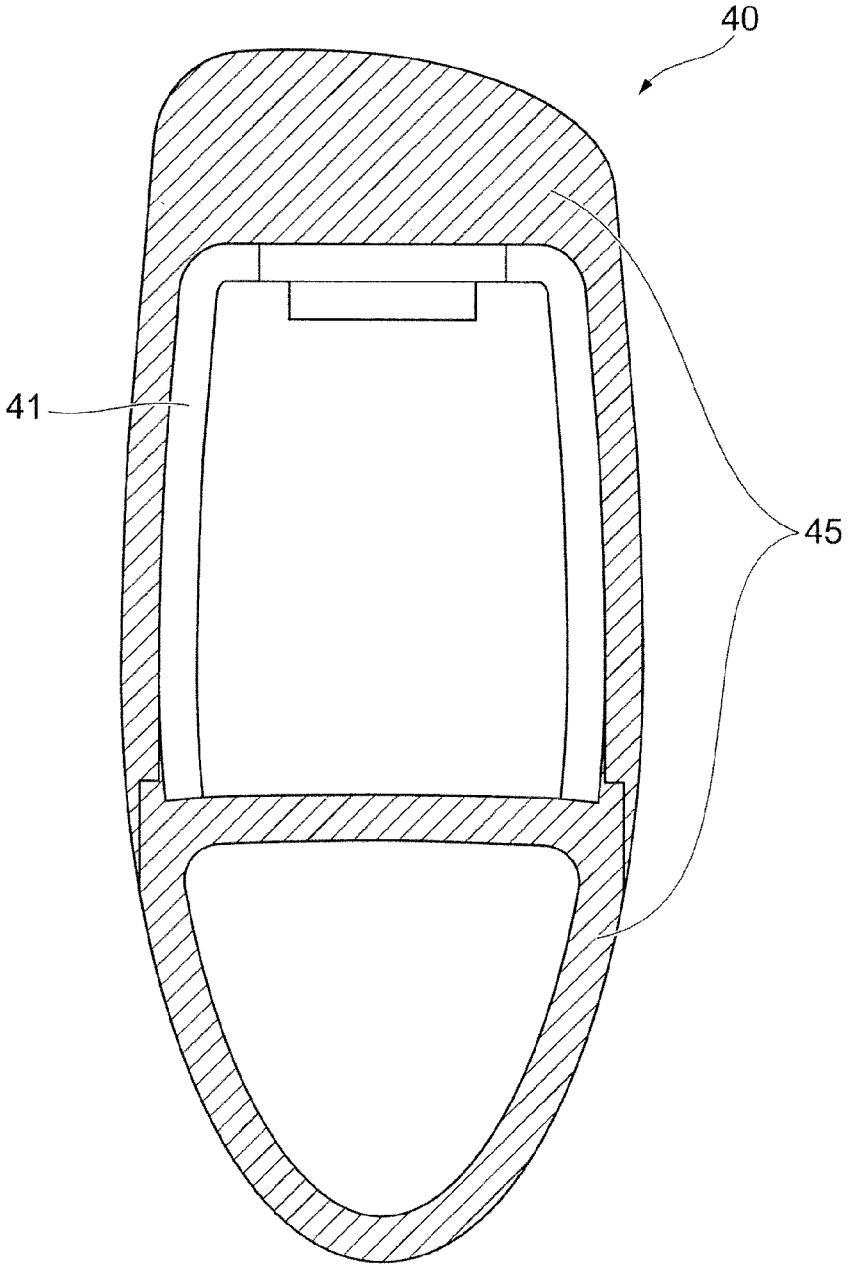
FIG. 13 is a view illustrating a configuration of a motor support member according to a third embodiment.

FIG. 13 is a view illustrating a configuration of a motor support member 40 according to a third embodiment.

According to the third embodiment, the motor support member 40 is installed such that a rectifying member 45 surrounds a motor supporter 41. That is, the motor support member 40 includes the motor supporter 41 having a substantially inverted U-shaped cross section as shown in the drawing, and the rectifying member 45 covering an upstream side, opposite sides and a downstream side of the motor supporter 41.

The rectifying member 45 includes a member formed to have a gradually increasing diameter to form an upstream portion of the motor support member 40 and a member covering the opposite sides and the downstream side of the motor support member 41 to form the maximum width portion and the downstream portion of the motor support member 40.

The downstream side of the rectifying member 45 is formed in the same shape as the additional rectifying member 44 according to the second embodiment. That is, the downstream end of the rectifying member 45 is formed in a shape corresponding to the shape obtained by rotating a right half of the cross-sectional shape of the motor support member 40 by 90 degrees counterclockwise.

Fourth Embodiment

Figure 14A:
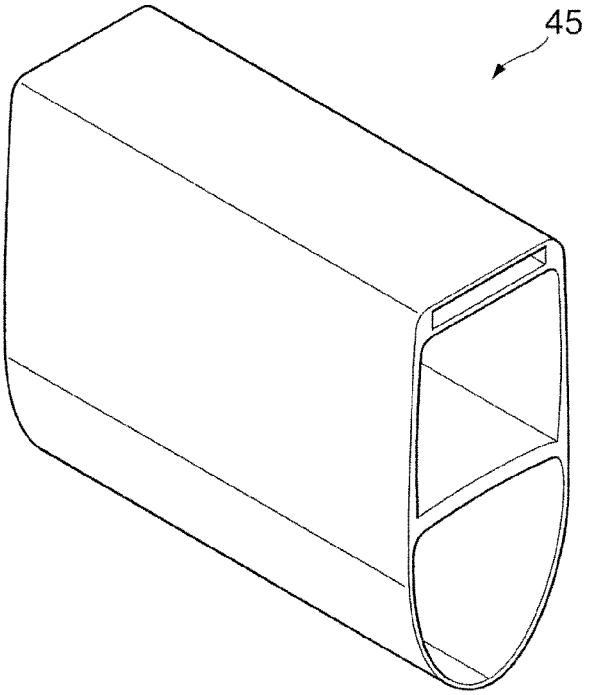
FIGS. 14A and 14B are views illustrating a case in which a motor supporter is surrounded by a rectifying member when the rectifying member is formed of resin in the motor supporting member according to a fourth embodiment.
Figure 14B:
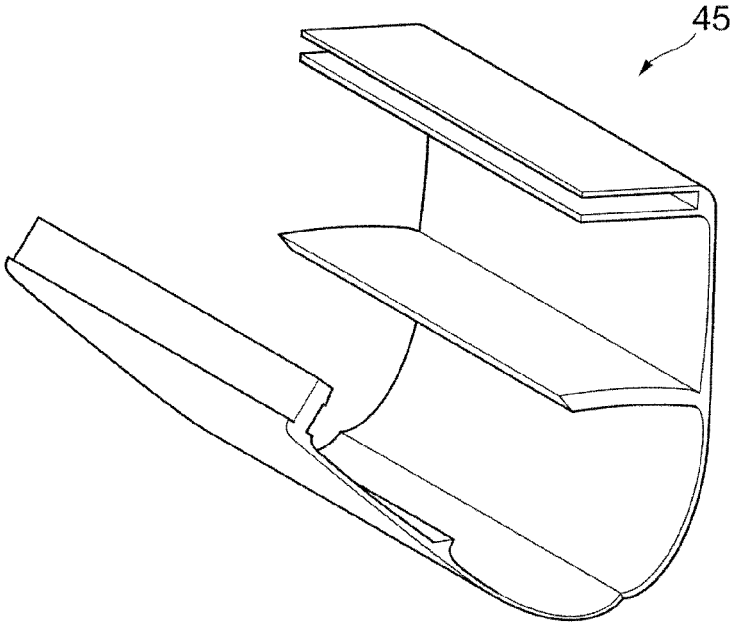

When a rectifying member 45 is formed of a resin material, the rectifying member 45 may be installed to cover opposite side surfaces and a downstream side of a motor supporter 41, as illustrated in a fourth embodiment of FIGS. 14A and 14B.

FIG. 14A is a view of a shape of the rectifying member 45 covering the motor supporter 41, and FIG. 14B is a view of a shape of the rectifying member 45 in the middle of the process of covering the motor supporter 41. However, in this case, a portion corresponding to the additional rectifying member 44 according to the second embodiment is omitted.

Figure 15:
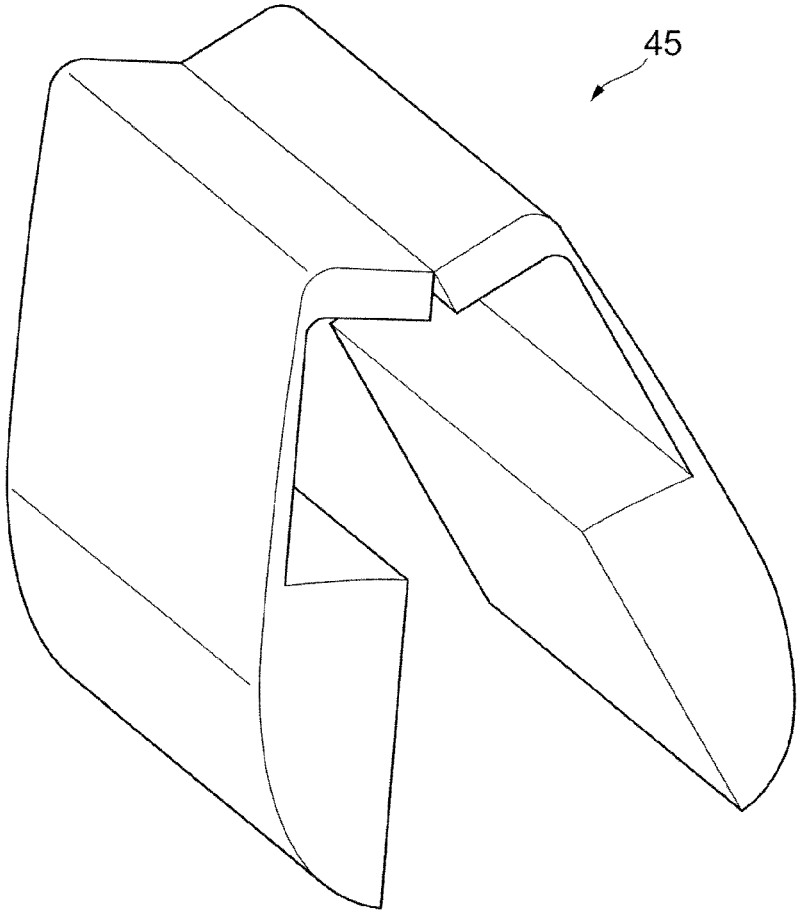
FIG. 15 is a view illustrating a case in which a motor supporter is surrounded by a rectifying member when the rectifying member is formed of a foaming agent in the motor supporting member.

Alternatively, the rectifying member 45 may be formed of a foam material. In such a case, it is appropriate that the motor supporter 41 is surrounded by the rectifying member 45, as illustrated in FIG. 15. FIG. 15 is a view of a shape of the rectifying member 45 in the middle of the process of covering the motor supporter 41. However, in this case, a portion corresponding to the additional rectifying member 44 according to the second embodiment is omitted.

Figure 16:
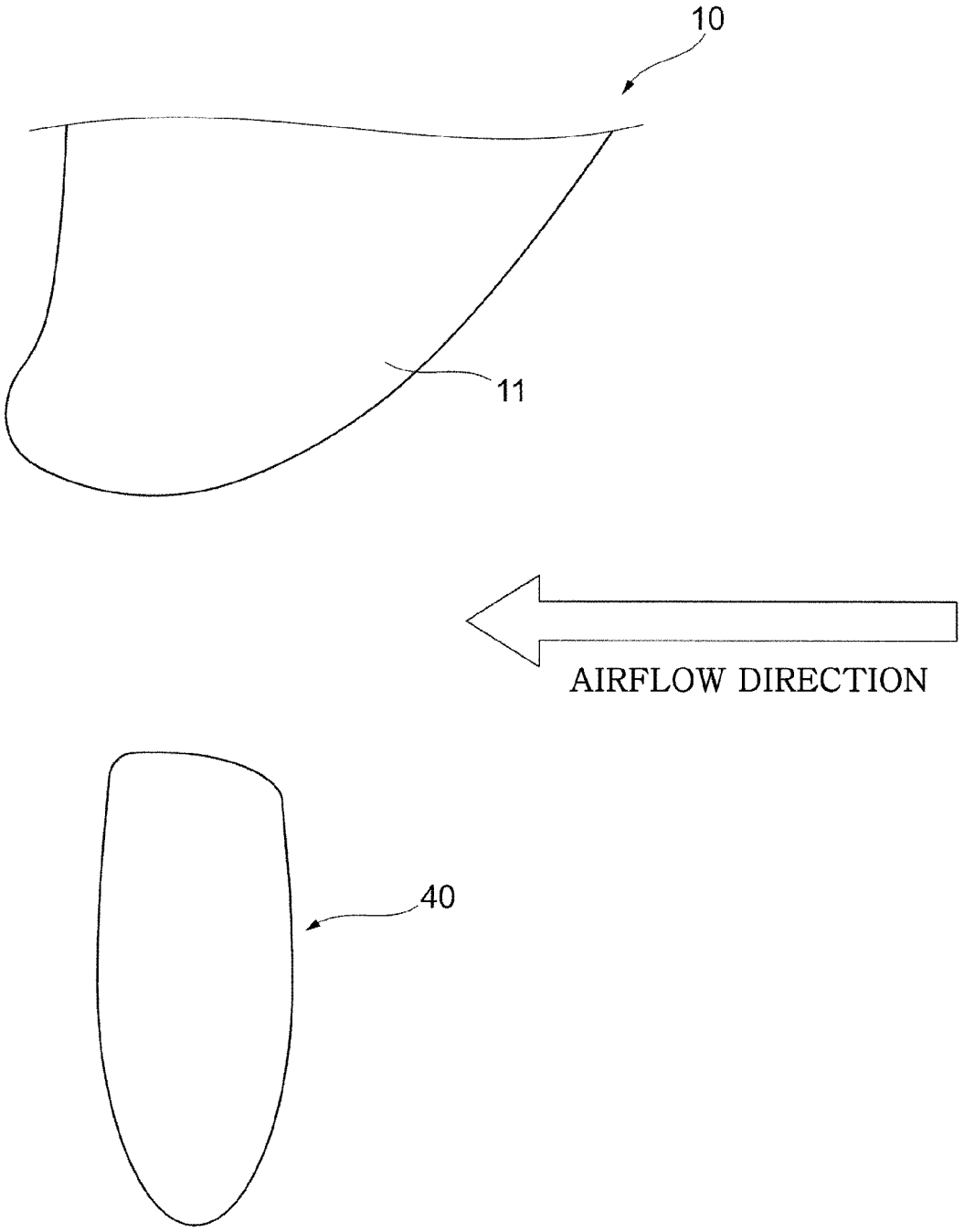
FIG. 16 is a view illustrating a relation between the motor support member and a front edge of a blade of a fan.

FIG. 16 is a view illustrating a relation between the motor support member 40, in which the rectifying member having the cross-sectional shape of the motor support member 40 is installed on a rear end portion, and a front edge 11 of a blade of a fan 10. By installing the rectifying member having the cross-sectional shape of the motor support member 40 on the rear end portion, the flow, which is separated by the motor support member 40 with respect to the rotational flow direction of the air indicated by the white arrow, may flow smoothly.

Next, a description related to a configuration in a longitudinal direction perpendicular to the cross section of the motor support member 40 will be described.

Figure 17:
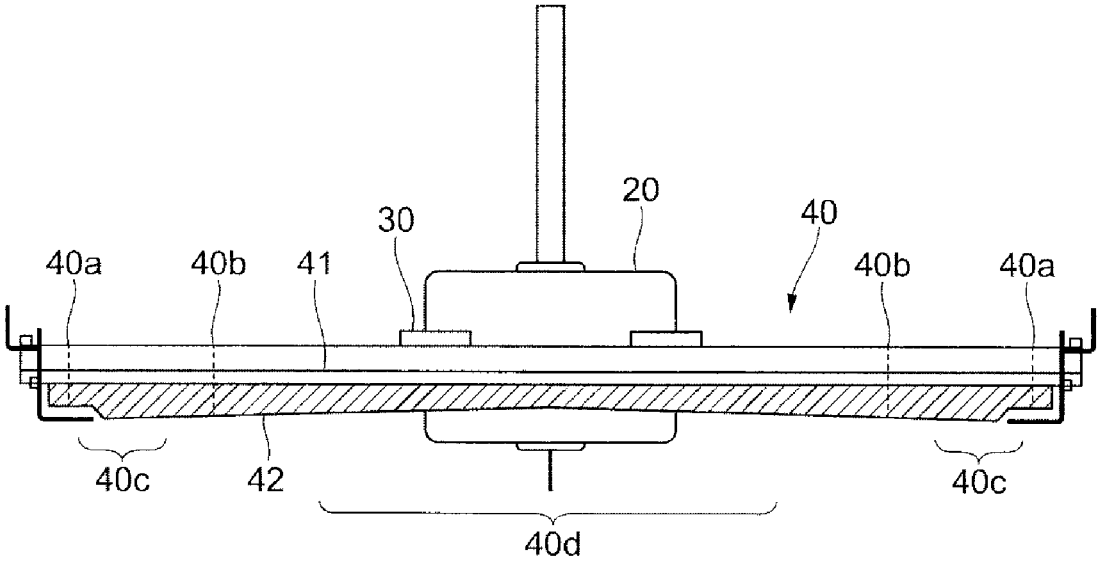
FIG. 17 is a side cross-sectional view illustrating a motor, a leg portion, and the motor support member.

FIG. 17 is a view illustrating the configuration composed of the motor 20, the leg portion 30 and the motor support member 40 when viewing from the side surface of the outdoor unit 1. The left side of the drawing is the front side of the outdoor unit 1 and the right side of the drawing is the rear side of the outdoor unit 1. The motor support member 40 according to the embodiment employs the motor support member 40 according to the first embodiment. That is, the motor support member 40 includes the motor supporter 41 and the rectifying member 42.

As illustrated in FIG. 17, from the front side of the outdoor unit 1 to the rear side of the outdoor unit 1, a cross-sectional shape in the longitudinal direction of the motor support member 40 has a cross-sectional shape 40*a*, at first. Subsequently, a cross-sectional shape of the motor support member 40 is changed through a sectional shape-changing region 40*c* and then becomes a cross-sectional shape 40*b*. The cross-sectional shape of the motor support member 40 is changed through a sectional shape-changing region 40*d* and then returns to the cross-sectional shape 40*b*. In addition, the cross-sectional shape of the motor support member 40 is changed through a sectional shape changing region 40*c* and then returns to the cross-sectional shape 40*a*.

As mentioned above, it is appropriate to change a cross-sectional shape of the motor support member 40 in the longitudinal direction while maintaining a cross-sectional shape of the motor support member 40 as the cross-sectional shape (the cross-sectional shape of FIG. 2). That is, a cross section, which is generated by being cut out in another plane according to the airflow, may have another shape satisfying the condition of the cross-sectional shape according to the embodiments.

The cross-sectional shape of the motor support member 40 (the cross-sectional shape of FIG. 2) may be formed on some portions of the motor support member 40.

That is, it is appropriate to apply the above-described cross-sectional shape to the position adjacent to the blade of the fan 10 in the motor support member 40 or the position adjacent to the motor 20.

FIG. 17 illustrates that the rectifying member 42, which is integrated in the longitudinal direction of the motor support member 40, is used as the rectifying member 42, but is not limited thereto. It is also possible to use the rectifying member 42, which is divided into a plurality of portions in the longitudinal direction of the motor support member 40.

That is, the rectifying member 42 may be divided into a plurality of portions in the longitudinal direction of the motor support member 40.

In FIG. 17, a mounting portion 70 for mounting the motor support member 40 to a housing of the outdoor unit 1 is indicated by thick black lines on the right and left sides of the motor support member 40. Although not shown in FIG. 1, the mounting portion 70 is installed on the left side and the right side of the inner front surface and the rear surface of the housing of the outdoor unit 1.

Hereinafter a method of mounting the motor support member 40 will be described in detail.

Figure 18A:
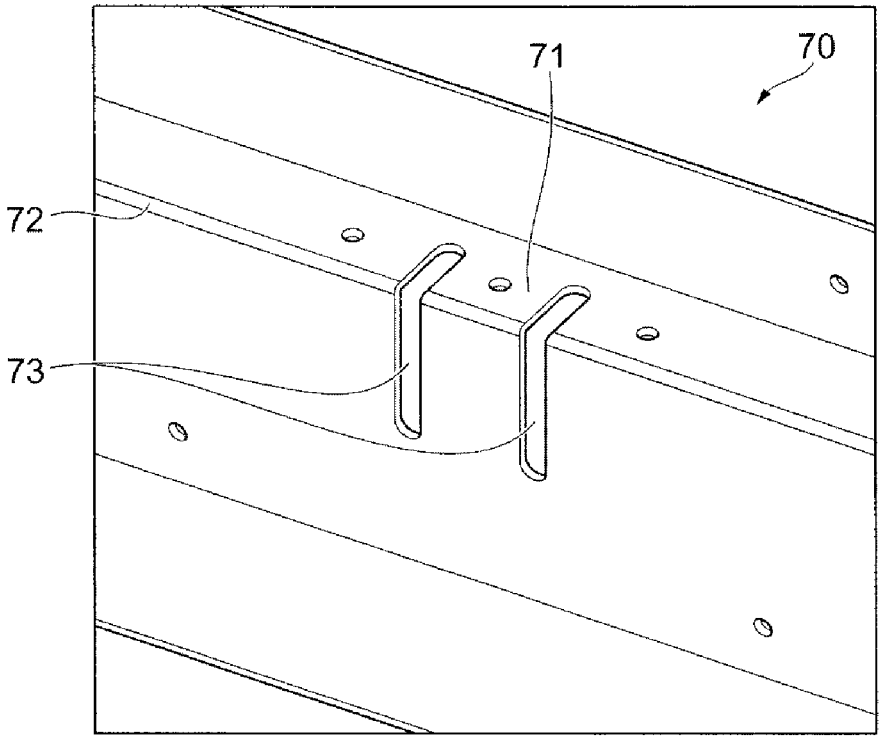
FIGS. 18A and 18B are views illustrating a state of a mounting portion before and after the motor support member is mounted to the mounting portion.

FIG. 18A is a view illustrating a state of the mounting portion 70 before the motor support member 40 is mounted to the mounting portion 70. As illustrated in FIG. 18A, a bent portion 72 is provided on the mounting portion 70 to secure an installation sheet surface 71 of the motor support member 40, and a pair of slits 73 is provided in the bent portion 72. The pair of slits 73 is inserted into opposite side surface portions 412 and 413 of the motor supporter 41.

Figure 18B:
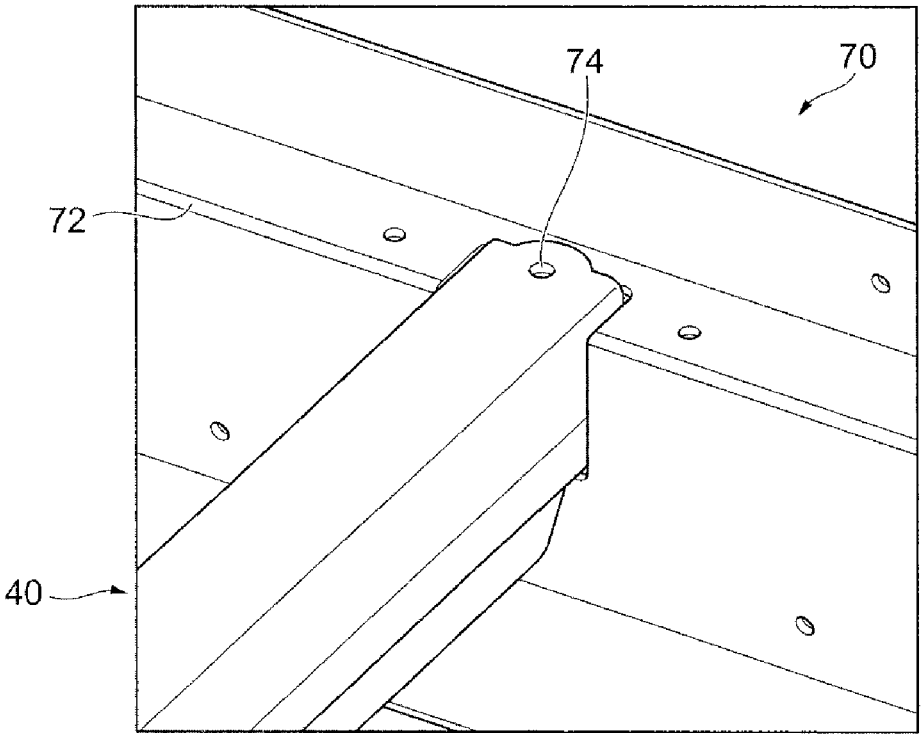

FIG. 18B is a view illustrating a state of the mounting portion 70 after the motor support member 40 is mounted to the mounting portion 70. In a state in which the motor support member 40 is inserted into the slit 73, the screw 74 is fastened and thus the motor support member 40 is fixed to the installation sheet surface 71. The screw 74 may be fastened from above with respect to the drawing.

Fifth Embodiment

Figure 19:
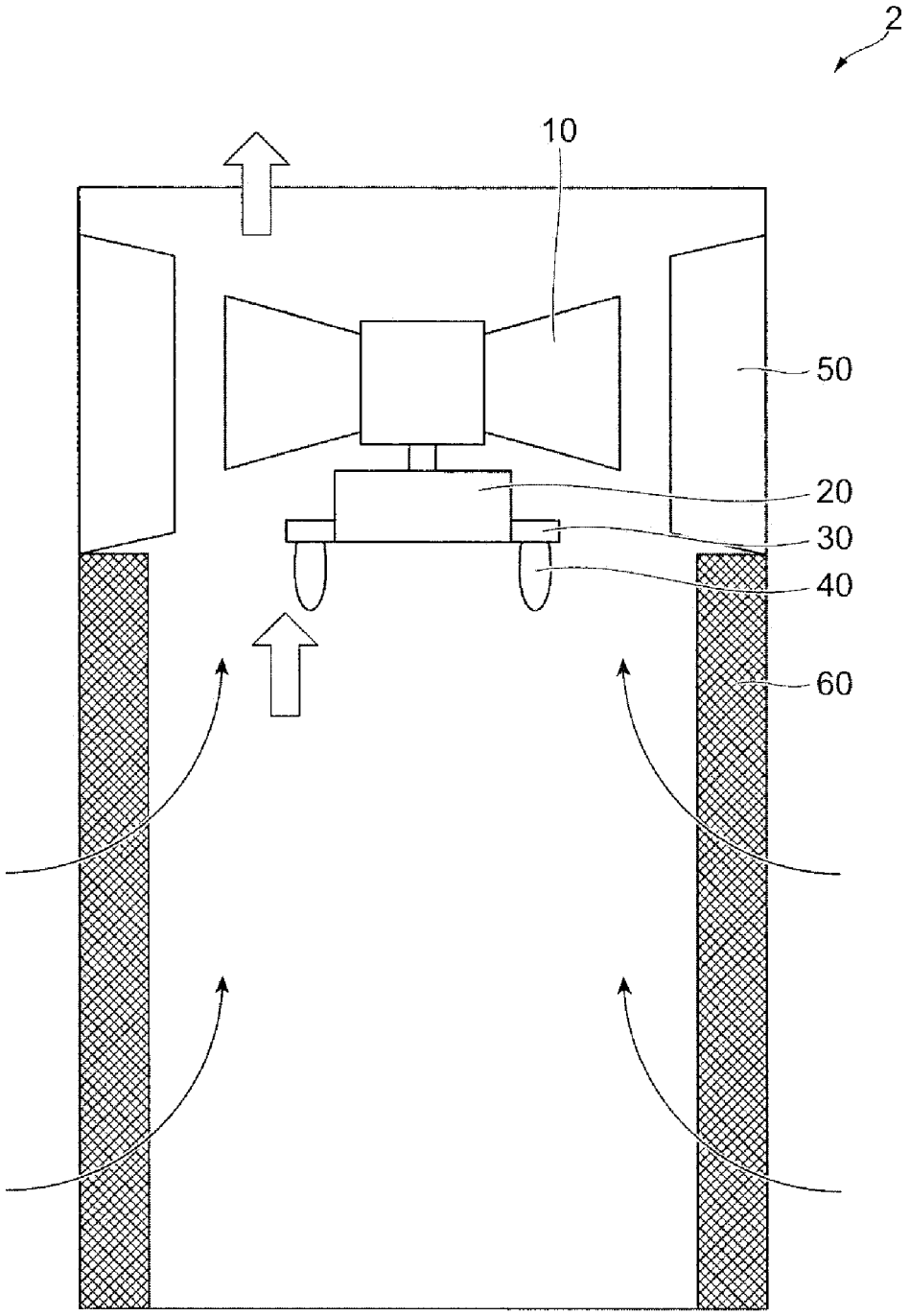
FIG. 19 is a schematic view illustrating an outdoor unit of air conditioner according to a fifth embodiment.

FIG. 19 is a schematic view illustrating an outdoor unit 2 of air conditioner according to a fifth embodiment. As illustrated in FIG. 19, the outdoor unit 2 includes a fan 10, a motor 20, a leg portion 30, a motor support member 40, a bell mouth 50, and a heat exchanger 60. The functions of the fan 10, the motor 20, the leg portion 30, the motor support member 40, the bell mouth 50 and the heat exchanger 60 are the same as those of the outdoor unit 1 of the first embodiment and thus a description thereof will be omitted.

The outdoor unit 2 according to the fifth embodiment is an upper surface blower type in the same manner as the outdoor unit 1 according to the first embodiment. In addition, the outdoor unit 2 is a type in which the motor support member 40 is disposed upstream of the airflow direction of the fan 10. However, the motor support member 40 is disposed lower than an upper portion of the heat exchanger 60, such as the motor support member 40 is installed on a position overlapped with the heat exchanger 60 in the height direction, which is different from the outdoor unit 1 according to the first embodiment. In other words, the motor support member 40 is installed on a position overlapped with the heat exchanger 60 in the airflow direction.

Sixth Embodiment

Figure 20:
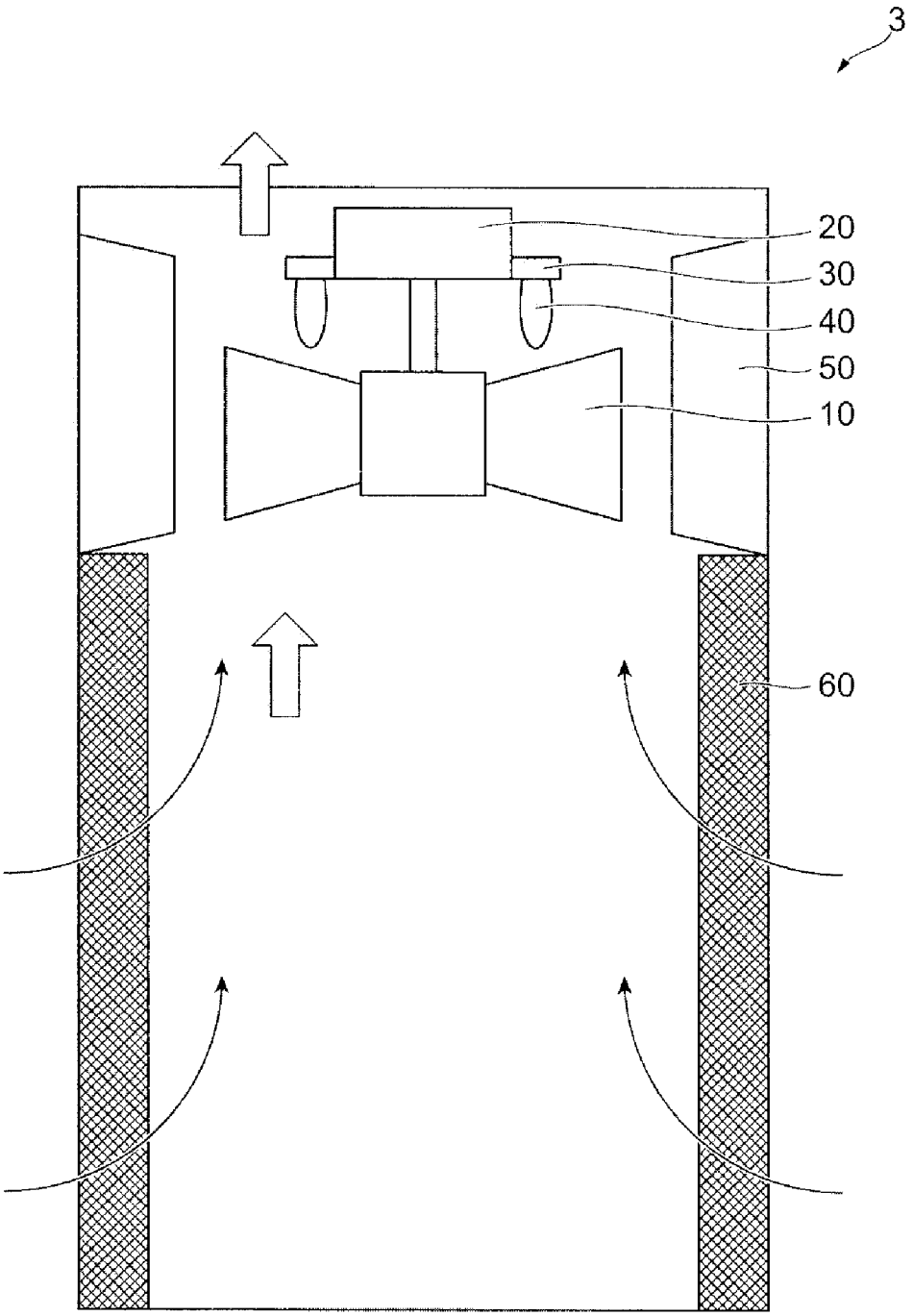
FIG. 20 is a schematic view illustrating an outdoor unit of air conditioner according to a sixth embodiment.

FIG. 20 is a schematic view illustrating an outdoor unit 3 of air conditioner according to a sixth embodiment. As illustrated in FIG. 20, the outdoor unit 3 includes a fan 10, a motor 20, a leg portion 30, a motor support member 40, a bell mouth 50, and a heat exchanger 60. The functions of the fan 10, the motor 20, the leg portion 30, the motor support member 40, the bell mouth 50 and the heat exchanger 60 are the same as those of the outdoor unit 1 of the first embodiment and thus a description thereof will be omitted.

The outdoor unit 3 according to the sixth embodiment is an upper surface blower type in the same manner as the outdoor unit 1 according to the first embodiment. However, the outdoor unit 3 is a type in which the motor support member 40 is disposed downstream of the airflow direction of the 10, which is different from the outdoor unit 1 according to the first embodiment.

Seventh Embodiment

Figure 21:
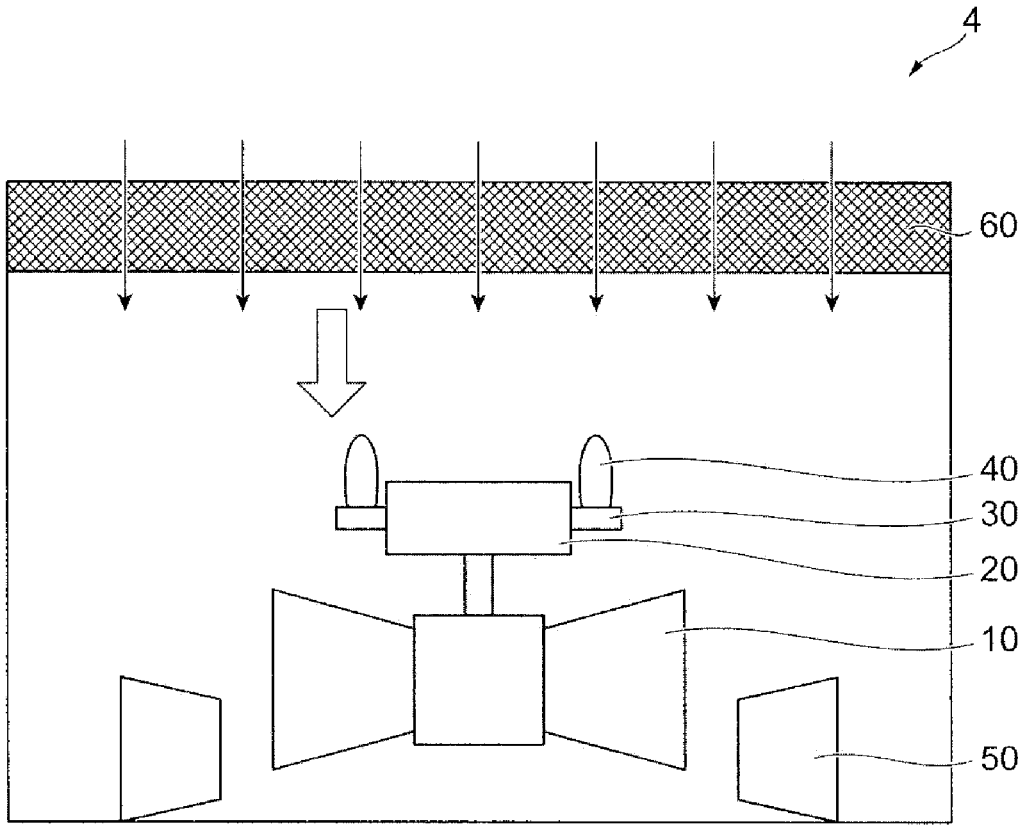
FIG. 21 is a schematic view illustrating an outdoor unit of air conditioner according to a seventh embodiment.

FIG. 21 is a schematic view illustrating an outdoor unit 4 of air conditioner according to a seventh embodiment.

As illustrated in FIG. 21, the outdoor unit 4 includes a fan 10, a motor 20 driving the fan 10, a leg portion 30, a motor support member 40, a bell mouth 50, and a heat exchanger 60. The functions of the fan 10, the motor 20, the leg portion 30, the motor support member 40, the bell mouth 50 and the heat exchanger 60 are the same as those of the outdoor unit 1 of the first embodiment and thus a description thereof will be omitted.

The outdoor unit 4 according to the seventh embodiment is a side surface blower type, which is different from the outdoor unit 1 according to the first embodiment. That is, the embodiments may be applicable to the side surface blower type outdoor unit.

Effect of this Embodiment

As is apparent from the above description, according to the proposed blower and outdoor unit, the airflow may be generated along the reduction portion of the motor support member 40 by improving the cross-sectional shape of the motor support member 40. Therefore, it is possible to form the airflow having a virtual wing shaped cross-sectional shape, and thus it is possible to prevent the width of the vortex from being more increased than the width of the motor support member 40.

In addition, the cross-sectional shape of the motor support member 40 has a shape in which a rear end portion is cut out. Therefore, by forming the airflow having a virtual wing shaped cross-sectional shape, which is along the incident angle to some extent against the airflow having the incident angle, it is possible to prevent the width of the vortex from being increased.

The cross-sectional shape of the motor support member 40 has a shape in which a rear end portion of the reduction portion is cut out. Therefore, it is possible to reduce the flow resistance since a frontal projected area of the motor support member 40 is reduced with respect to the air flow having the incident angle.

Further, since the shape of the rear portion of the motor support member 40 is improved, it is possible to prevent interference between the rear end of the streamlined shape and the airflow in the blade rotation direction, which is a weak point of the streamlined shape.

By reducing the pressure loss in the air flow path and by reducing the change in the vortex and the speed in the upstream of the blade, it is possible to reduce the temporal change of the pressure on the blade surface so as to reduce the noise of the blowing air. In addition, it is possible to sufficiently reduce the noise in the motor support member 40.

In addition, since the cross sectional shape of the motor support member includes the upstream portion having the width that is increased from the upstream side to the downstream side, and the downstream portion having the width that is reduced from the upstream side to the downstream side, it is possible to reduce the width of the vortex generated in the rear side of the motor support member and thus it is possible to reduce the flow resistance and the noise.

Although a few embodiments of the present disclosure have been shown and described, it would be appreciated by those skilled in the art that changes may be made in these embodiments without departing from the principles and spirit of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. An outdoor unit of an air conditioner, the outdoor unit comprising:

a blower configured to flow air;

a heat exchanger disposed upstream of an airflow direction of the blower; and a housing configured to accommodate the blower and the heat exchanger, wherein the blower comprises a fan, a motor driving the fan, and a motor support member disposed on a flow path, through which air generated by a rotation of the fan flows, to support the motor, wherein the motor support member has a cross-sectional shape comprising:

an upstream portion having a first length and a width that continually increases over an entirety of the first length of the upstream portion from a first width at an upstream end of the upstream portion, to a maximum width, at a downstream side of the airflow direction, and a downstream portion having a second length and a width that continually decreases over an entirety of the second length of the downstream portion from the maximum width to a second width, at a downstream end of the downstream side of the airflow direction, wherein the maximum width is a plane of transition between the upstream portion and the downstream portion and is perpendicular to the airflow direction, wherein an overall length of the motor support member is based only on the first length of the upstream portion that continually increases in width and the second length of the downstream portion that continually decreases in width, wherein the second width is larger than the first width, and wherein the downstream end of the downstream portion is a linear shape of the second width and is in a direction perpendicular to the airflow direction.

2. The outdoor unit of claim 1, wherein:

the upstream portion has a cross-sectional shape having a width curvedly increased, the downstream portion has a cross-sectional shape having a width curvedly reduced, and the upstream portion and the downstream portion have a cross-section curvedly connected therebetween.

3. The outdoor unit of claim 1, wherein a ratio of an upstream portion length to the maximum width is equal to or greater than 1.00 and equal to or less than 1.50.

4. The outdoor unit of claim 3, wherein a ratio of a downstream portion length to the upstream portion length is equal to or greater than 0.58 and equal to or less than 1.00.

5. The outdoor unit of claim 4, wherein a ratio of a downstream end width to the maximum width is equal to or greater than 0.86 and equal to or less than 0.94.

6. The outdoor unit of claim 1, wherein the cross-sectional shape of the motor support member is formed in a longitudinal direction of the motor support member.

7. The outdoor unit of claim 6, wherein the cross-sectional shape of the motor support member is adjacent to a blade of the fan.

8. The outdoor unit of claim 6, wherein the cross-sectional shape of the motor support member is adjacent to the motor.

9. The outdoor unit of claim 1, wherein the motor support member comprises:

a motor supporter formed of a metal material to form a downstream side of the motor support member; and a rectifier formed of a resin material to form an upstream side of the motor support member.

10. The outdoor unit of claim 9, wherein:

the motor supporter comprises an opening opened toward the upstream side of the motor support member, and the rectifier is provided such that a downstream end portion thereof is inserted into the opening.

11. The outdoor unit of claim 9, wherein the motor support member further comprises a seal configured to seal between the motor supporter and the rectifier.

12. The outdoor unit of claim 1, further comprising:

an additional rectifier installed on a cross section of a downstream side of a motor supporter.

13. The outdoor unit of claim 12, wherein the additional rectifier corresponds to a shape obtained by rotating a half of the cross-sectional shape of the motor support member by 90 degrees clockwise or counterclockwise.

14. The outdoor unit of claim 12, further comprising:

a step formed such that a width of the additional rectifier is smaller than a downstream end width of the motor supporter.

15. The outdoor unit of claim 9, wherein:

the motor supporter comprises an opening opened toward the upstream side, and the rectifier surrounds the upstream side, opposite side surfaces and the downstream side of the motor supporter.

16. The outdoor unit of claim 15, wherein a downstream end portion of the rectifier corresponds to a shape obtained by rotating a half of one side end portion of the motor support member by 90 degrees clockwise or counterclockwise.

17. A blower comprising:

a fan;

a motor driving the fan; and a motor support member disposed on a flow path, through which air generated by a rotation of the fan flows, to support the motor, wherein the motor support member has a cross-sectional shape comprising:

an upstream portion having a first length and a width that continually increases over an entirety of the first length of the upstream portion from a first width, at an upstream end of the upstream portion, to a maximum width, at a downstream side of an airflow direction, and a downstream portion having a second length and a width that continually decreases over an entirety of the second length of the downstream portion from the maximum width to a second width, at a downstream end of the downstream side of the airflow direction, wherein the maximum width is a plane of transition between the upstream portion and the downstream portion and is perpendicular to the airflow direction, wherein an overall length of the motor support member is based on the first length of the upstream portion that continually increases in width and the second length of the downstream portion that continually decreases in width, wherein the second width is larger than the first width, and wherein the downstream end of the downstream portion is a linear shape of the second width and is in a direction perpendicular to the airflow direction.

18. The blower of claim 17, wherein:

the upstream portion has a cross-sectional shape having a width curvedly increased, the downstream portion has a cross-sectional shape having a width curvedly reduced, and the upstream portion and the downstream portion have a cross-section curvedly connected therebetween.

19. The blower of claim 17, wherein:

the motor support member comprises a motor supporter formed of a metal material to form a downstream side of the motor support member and a rectifier formed of a resin material to form an upstream side of the motor support member, and the motor supporter comprises an opening opened toward the upstream side of the motor support member, and the rectifier is provided such that a downstream end portion thereof is inserted into the opening.

20. The blower of claim 17, wherein:

the motor support member comprises a motor supporter formed of a metal material to form a downstream side of the motor support member and a rectifier formed of a resin material to form an upstream side of the motor support member, and the motor support member further comprises a seal configured to seal between the motor supporter and the rectifier.

* * * * *